United States Patent [19]

Hirotsu et al.

[11] Patent Number: 4,847,168

[45] Date of Patent: Jul. 11, 1989

[54] SLICING SAW BLADE

[75] Inventors: Sadao Hirotsu; Kazuo Hoshino; Sadayuki Nakamura, all of Yamaguchi, Japan

[73] Assignee: Nisshin Steel Co., Ltd., Tokyo, Japan

[21] Appl. No.: 144,341

[22] PCT Filed: Apr. 30, 1987

[86] PCT No.: PCT/JP87/00272

§ 371 Date: Dec. 29, 1987

§ 102(e) Date: Dec. 29, 1987

[87] PCT Pub. No.: WO87/06625

PCT Pub. Date: Nov. 5, 1987

[30] Foreign Application Priority Data

Apr. 30, 1986 [JP] Japan ..... 61-100513

[51] Int. Cl.[4] ..... B23D 61/18

[52] U.S. Cl. ..... 428/634; 30/346.53; 30/347; 420/60; 420/91

[58] Field of Search ..... 428/634; 420/60, 91, 420/117; 30/345, 346.53, 347, 350, 263

[56] References Cited

U.S. PATENT DOCUMENTS 3,190,047 6/1965 Villalobos ..... 30/345
4,378,246 3/1983 Hoshino et al. ..... 420/60

FOREIGN PATENT DOCUMENTS 2462 6/1979 European Pat. Off. ..... 30/347
2073775 10/1981 United Kingdom ..... 420/60

*Primary Examiner*—L. Dewayne Rutledge
*Assistant Examiner*—George Wyszomierski
*Attorney, Agent, or Firm*—Wenderoth, Lind & Ponack

[57] ABSTRACT

A slicing saw blade comprising a substrate disc and a blade edge consisting essentially of a ultra-hard material deposited along a peripheral edge of said substrate disc, said substrate disc being made of a steel consisting essentially of, by weight, not more than 0.10% of C, more than 1.0% but not more than 3.0% of Si, less than 0.5% of Mn, from 4.0% to 8.0% of Ni, from 12.0% of 18.0% of Cr, from 0.5% to 3.5% of Cu, not more than 0.15% of N and not more than 0.004% of S, the sum of C and N being at least 0.10%, the balance being Fe and inavoidable impurities. The saw blade is useful for the production of wafers of a semiconductive material, and has a long service life.

2 Claims, 4 Drawing Sheets

SLICING SAW BLADE

TECHNICAL FIELD

The invention relates to a saw blade suitable for use in slicing a rod of a semiconductive material into wafers.

BACKGROUND

Wafers of a semiconductive material such as a single crystal of Si or Ga—As compounds are produced by slicing a rod of the material using a saw blade. The saw blade normally comprises a substrate in the shape of a very thin disc onto which diamond is electrically deposited. More particularly a thin annular disc having a round hollow scooped at its center is used as the substrate, and along the peripheral edge portions of the round hollow particulate diamond is electrically deposited with a width of several millimeters to provide a blade edge. Upon slicing a rod of a semiconductive material to wafers, the saw blade is rotatably mounted on a slicing machine, and the rod is passed through the round hollow of the rotating blade so that the edge portions of the round hollow may serve as the slicing blade edge.

As a substrste of such saw blade use has heretofore been made of stainless steels, such as thin cold rolled materials of SUS304 and SUS301, optionally age hardened. A thin substrate of such a material poses a problem in that it frequently undergoes, because of its low strength, shape distortion and/or fatigue breakage during service, rendering the service life of the saw blade short, and therefore, it has been necessary to use a relatively thick substrate. However, the thicker the substrate the more the slicing loss. It is important to achieve the smallest possible slicing loss to prevent reduction of the yield.

As an approach it has been proposed to use as the substrate of a saw blade a drastically cold worked material of a quasi-stable austenitic stainless steel, such as SUS301, which material exhibits a satisfactory strength even with a thin thickness. In this case, however, the drastic cold working results in reduction of toughness and elongation of the material. Accordingly, the substrate made of such a material may break at the time the saw blade is mounted on a slicing machine, or may tear during service to destroy the material being sliced, such as a single crystal of Si.

As another approach there has been an attempt to use as the substrate of a saw blade a certain precipitation hardenable stainless steel, such as SUS631. This steel can be age hardened to a certain level of strength. However, it contains Al, which is an element having great affinity to oxygen and nitrogen, in an amount of from 0.75 to 1.5%, posing problems, including formation of aluminous non-metallic inclusions during steel making, formation of A1N and aggregated inclusions thereof during casting, not only rendering surface textures of the product coarse, but also adversely affecting toughness and elongation, leading to a remarkably shortened fatigue life of the product. The above-mentioned precipitation hardenable steel is not completely satisfactory as a material for the substrate of slicing saw blades.

OBJECT OF THE INVENTION

An object of the invention is to provide a thin saw blade of high strength and elongation, suitable for use in slicing a rod of a semiconductive material into wafers.

DISCLOSURE OF THE INVENTION

According to the invention there is provided a slicing saw blade comprising a substrate disc and a blade edge of a ultra-hard material deposited along a peripheral edge of said substrate disc, said substrate disc being made of a steel consisting essentially of, by weight, not more than 0.10% of C, more than 1.0% but not more than 3.0% of Si,less than 0.5% of Mn, from 4.0% to 8.0% of Ni, from 12.0% of 18.0% of Cr, from 0.5% to 3.5% of Cu, not more than 0.15% of N and not more than 0.004% of S, the sum of C and N being at least 0.10%, the balance being Fe and unavoidable impurities.

DETAILED DESCRIPTION TO THE INVENTION

The saw blade according to the invention can be suitable used in the production of wafers of a semiconductive material, and has a remarkably prolonged service life when compared with known saw blades having a substrate made of conventional materials. Further, it exhibits sufficient strength even with a thin thickness.

Figure 3:
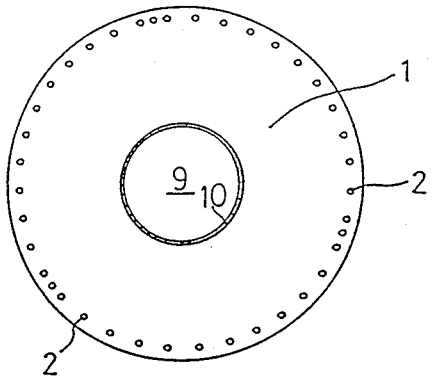
FIG. 3 is a plan view showing saw blades used in Examples described here-in-after.

The shape of the disc substrate of the saw blade according to the invention is not particularly restricted. The substrate may be an annular disc having a round hollow scooped at its center, as is the case with conventional saw. blades. A ultra-hard material such as diamond is mounted on the substrate disc to provide a blade edge. According to the most preferable embodiment of the invention the slicing saw blade is of a so-called inner diameter type and comprises a thin annular substrate disc of the steel mentioned above having a round hollow at its center and a blade edge consisting essentially of particulate diamond electrically deposited firmly along inner peripheral edge portions of said annular substrate disc. The blades used in Examples noted herein-after were of this type. FIG. 3 is a plane view of such a blade. In FIG. 3, the reference numeral 1 designates a thin annular substrate disc of the steel prescribed herein. The reference numeral 9 designates a round hollow provided at the center of the substrate disc. The reference numeral 10 designates a blade edge consisting essentially of particulate diamond electrically deposited along inner peripheral edge portions of the annular disc. The annular disc is provided with a plurality of apertures 2 along its outer periphery. The apertures provide passages of bolts for mounting the saw blade on a slicing machine.

In respect of the saw blade according to the invention, its shape, the construction of the blade edge and the manner of mounting it on a slicing machine are known in themselves. The most characterizing feature of the saw blade according to the invention resides in the material of the substrate disc. The steel employed as the material of the substrate disc will now be described in detail.

The steel employed meets various requirements necessary as a substrate of a saw blade, without the necessity of drastic cold working that is required in the case of SUS301 and without the use of elements, such as Al, which may form harmful inclusions, that is required in the case of SUS631. In other words, the steel employed is designed so that properties necessary as a substrate of a saw blade may be imparted by a combination of work hardening by moderate cold working with age hardening using hardening elements which do not form inclusions. More particularly, the steel employed basically contains from 12.0% to 18.0% of Cr and from 4.0% to 8.0% of Ni. We add Si to such a steel in an amount of not less than 1.0% (but not more than 3.0%), thereby to strengthen the steel and to facilitate induction of a martensitic phase ( formation of a work-induced martensite). We utilize C and N, which are martensite-strengthening elements, in an amount of at least 0.1% in sum so that the martensitic phase, which may be ready induced by slight cold working from a quasistable austenitic phase containing Si dissolved therein, may be further hardened by Si, C and N, whereby making it possible to realize a combination of good strength and elongation by moderate cold working. Further, we add an appropriate amount of Cu, which does not pose a problem of inclusions formation and cooperates with Si to contribute to age hardening, thereby to realize still greater strength. Constituents of the steel employed are adjusted so that the steel exhibits a quasi-stable austenitic phase in the solution treated condition, and therefore, steel sheet making processes and saw blade fabricating techniques known with the conventional work hardening austenitic stainless steels and precipitation hardening stainless steels are applicable here, Criticality of the chemistry of the steel employed will now be described.

C is an austenite former, and is very effectively acts to suppress formation of delta-ferrite at an elevated temperature and to strengthen the martensitic phase induced by cold working. However, the increased Si in the steel employed lowers the solubility of C in the steel. Consequently, if C is excessively high, Cr carbide may precipitate in the grain boundaries, causing deterioration of inter-granular corrosion resistance and elongation. For this reason the upper limit for C is now set as 0.10%.

Si is conventionally used for the purpose of deoxygenation of steels. The amount of Si added for the deoxygenation purpose is normally not more than 1.0%, as is the case with work hardening austenitic stainless steels, such as SUS301 and 304, and with precipitation hardening stainless steels, such as SUS631. To the steel employed we add more than 1.0% of Si to promote induction of martensite by cold working, thereby to increase a relative ratio of martensite to austenite after cold working. Si serves to strengthen and harden the formed martensitic phase, and also dissolves in the retained austenitic phase to strengthen the latter, whereby strength of the cold worked steel may be further increased. To enjoy such effects of Si, more than 1.0% of Si is required. On the other hand, with Si in excess of 3.0%, crackings may appear at an elevated temperature, posing difficulties in the sheet making process. For these reasons, Si is now set as more than 1.0% but not more than 3.0%.

Mn is an element which determines stability of austenire, and utilization of Mn should be considered in balance with other elements. In the case of the invention an unduly high Mn content adversely affects elongation of the disc. Accordingly, we set Mn as less than 0.5%.

Ni is essential to obtain an austenitic phase at elevated and ambient temperatures. In the case of the steel employed, it is essential to provide an austenitic phase which is quasi-stable at ambient temperature and from which a martensitic phase may be induced by cold working. If the Ni content is substantially less than 4.0%, delta-ferrite tends to be formed at an elevated temperature and the austenite phase does not easily become quasi-stable at ambient temperature. On the other hand, if the Ni content substantially exceeds 8.0%, it becomes difficult to induce martensite by cold working. For these reasons Ni is set at from 4.0% to 8.0%.

Cr is added to render the blade substrate corrosion resistant. For this purpose at least 12.0% of Cr is required. However, if the Cr content is excessively high, delta-ferrite is formed at an elevated temperature, since Cr is a ferrite former, and thus, it becomes necessary to add sufficient amounts of austenite formers, such as C, N, Ni, Mn and Cu to suppress formation of delta-ferrite. Addition of such austenite formers makes the austenitic phase stable at ambient temperature, and in consequence, a desired high strength can not be obtained by cold working and even by subsequent age hardening heat treatment. The balance of Cr and austenite formers is important. For the purpose of the invention up to 18.0% of Cr is permissible provided that the steel contains C, N, Ni, Mn and Cu in amounts prescribed herein. Accordingly, we set the upper limit for Cr at 18.0%.

Cu, as described here-in-before, cooperates with Si upon age hardening heat treatment to strengthen the steel. For appreciable effect at least 0.5% of Cu is required. On the other hand, unduly high Cu may be a cause of cracking. Cu is set at from 0.5% to 3.5%.

N is an austenite former, and very effectively acts to harden both the austenitic and martensitic phases. However, unduly high N may be s cause of formation of blow holes upon casting. For this reason the upper limit for N is set as 0.15%.

S, in the presence of Mn, forms MnS, which may adversely affect elongation. While S is particularly harmful within the steel employed herein, 0.004% or less of S may be permitted as bringing about no actual harm. The upper limit for S is now set as 0.004%.

C and N, as described hereinbefore, similarly operate and bring about similar effects. For the purpose of the invention, they are interexchangable, and it is necessary that the sum of them is at least a certain level. We set the sum of C and N at least 0.10%.

Besides the constituents mentioned above, it should be appreciated that residual amounts of Al and Ti normally employed for deoxygenation purpose, Ca and REM ( rare earth metals) normally added as desulfurization agent) and impurities unavoidably coming into the steel in the course of the steel making process, are permitted so far as they do not alter the nature of the steel to a great extent.

Thus, the steel employed consists essentially of, by weight, not more than 0.10% of C, more than 1.0% but not more than 3.0 of Si, less than 0.5% of Mn, from 4.0% to 8.0% of Ni, from 12.0% of 18.0% of Cr, from 0.5% to 3.5% of Cu, not more than 0.15% of N and not more than 0.004% of S, the sum of C and N being at least 0.10%, the balance being Fe and unavoidable impurities. In the course of a process for manufacturing a thin sheet from such a steel, induction of a martensitic phase and age hardening heat treatment are carried out, thereby a combination of great strength and enhanced elongation which were not found in the conventional materials have been realized. The thin sheet so prepared can be fabricated into a substrate disc by a method known per se.

The invention will be illustrated by the following Examples.

Examples of Steel

Figure 1:
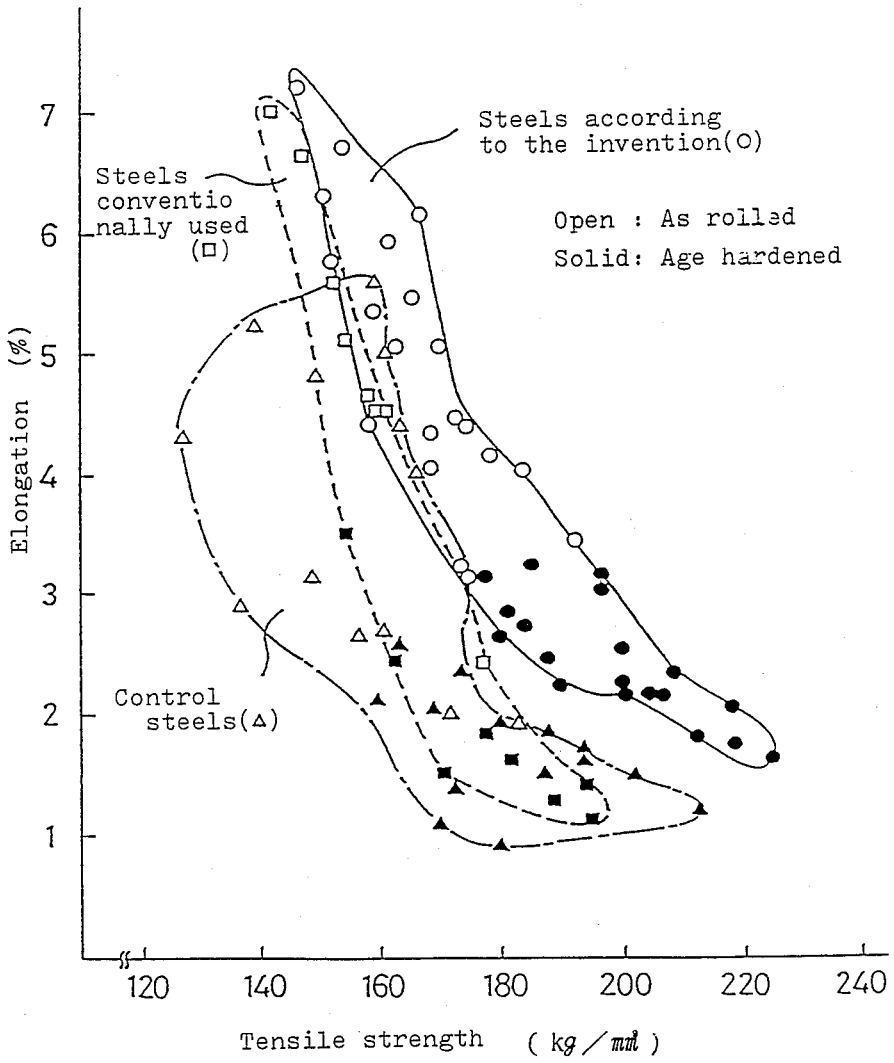
FIG. 1 graphically shows relationships between tensile strength and elongation of various steels, including those according to the invention, those conventionally used and control steels, in both the as rolled and age hardened conditions.
Figure 2:
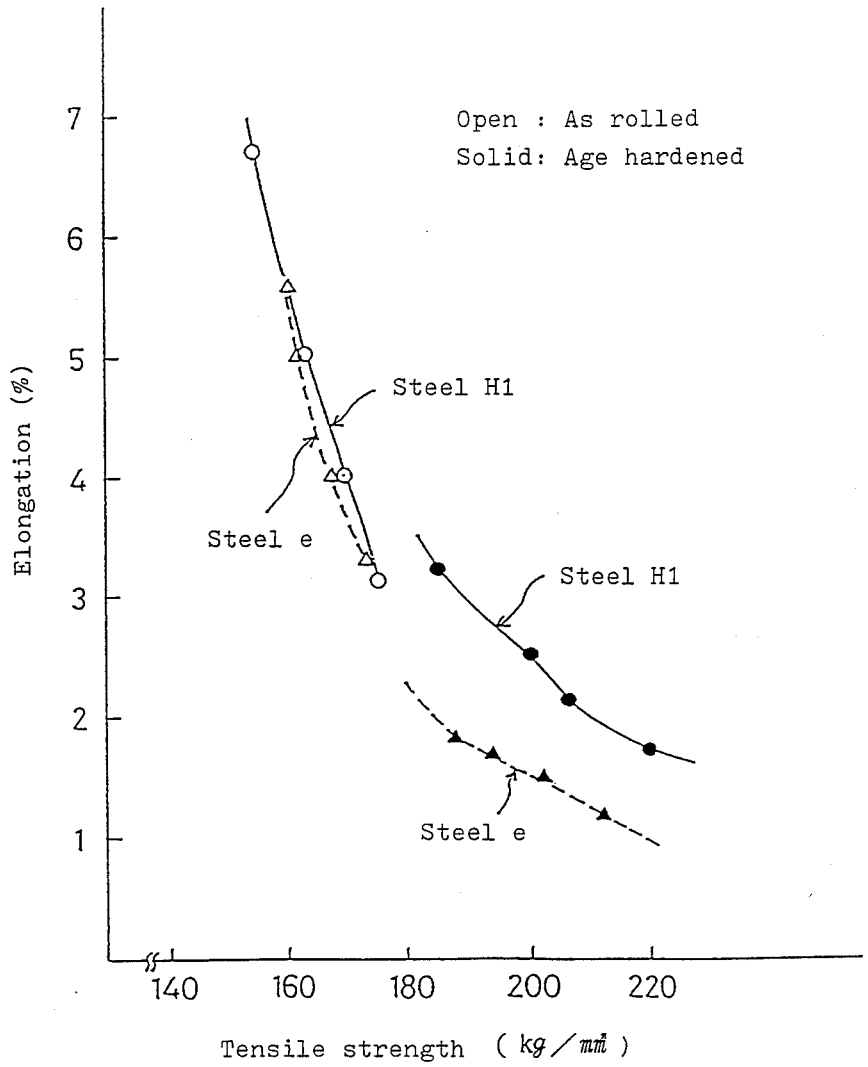
FIG. 2 graphically shows relationships between tensile strength and elongation of Steel H1, which is according to the invention, and Steel e, which is a control steel, in both the as rolled and age hardened conditions.

Steels prescribed herein (H1 to H7), steels conventionally used (A to C) and control steels (a to f), having chemical compositions indicated in Table 1, were cast, hot rolled in a usual manner and cold rolled at various reduction rates indicated in Tables 2-(1) and 2-(2) to prepare high strength cold rolled sheets. Specimens of the as rolled sheets were tested for amount of martensite induced by cold rolling ( alpha amount ), hardness, tensile strength and elongation. The sheets were age hardened under indicated conditions, and tested for hardness, tensile strength and elongation. Further, hardness differential, the difference between hardness before and after age hardening (ΔH), was determined for each tested specimen. The results are shown in Tables 2-(1) and 2-(2). Of the results shown in Tables 2, relationships between tensile strength and elongation are shown in FIG. 1. Further, FIG. 2 shows relationships between tensile strength and elongation on Steel H1 according to the invention and control Steel e. Among control steels tested, Steel e has properties in the as cold rolled condition and hardness differential which are the most similar to those of steels according to the invention.

Tables 2 show that steels according to the invention contain higher amounts of martensite than conventionally used steels when cold rolled at the same or even lower reduction rate. It is understood that martensite is more liable to be induced by cold rolling with steels according to the invention than with conventionally used steels.

As revealed from FIG. 1, steels according to the invention have higher tensile strength at the same level of elongation than conventionally used steels and control steels in both the as cold rolled and age hardened conditions. This means that tensile strength and elongation of steels according to the invention are superior to those of conventionally used work hardening austenitic and precipitation hardening stainless steels in both the as cold rolled and age hardened conditions. It is, therefore, possible to use a reduced reduction rated with steels according to the invention, ensuring better shape precision.

Tables 1 and 2 show that steels having high Si and Cu exhibit large hardness differential, indicating synergistic cooperation of Si and Cu upon age hardening. FIG. 2 shows that Steel e having unduly high Mn and S contents has lower elongation in the age hardened condition than Steel H1 according to the invention, indicating the fact that excessively high Mn and S impair toughness of the final product.

Steels C and a exhibit large hardness differential, indicating that tensile strength of these steels can be increased to a great extent by age hardening heat treatment. However, since their tensile strength in the as cold rolled condition is low, their tensile strength after age hardening is not very high. Incidentally, the large hardness differential of Steel C is attributed to precipitation of $Ni_3Al$ intermetallic compound.

TABLE 1

| | | (%) | | | | | | | | | |
|---|---|---|---|---|---|---|---|---|---|---|---|
| | Steel | C | Si | Mn | S | Ni | Cr | N | Cu | Al | Remarks |
| (1) | H1 | 0.028 | 2.67 | 0.46 | 0.002 | 6.50 | 15.88 | 0.103 | 1.75 | — | |
| | H2 | 0.059 | 2.72 | 0.42 | 0.001 | 6.56 | 15.97 | 0.099 | 1.74 | — | |
| | H3 | 0.060 | 1.22 | 0.32 | 0.002 | 6.53 | 16.46 | 0.062 | 1.79 | — | |
| | H4 | 0.030 | 1.41 | 0.20 | 0.001 | 6.56 | 16.52 | 0.112 | 1.79 | — | |
| | H5 | 0.065 | 1.42 | 0.35 | 0.003 | 7.32 | 16.20 | 0.096 | 0.98 | — | |
| | H6 | 0.075 | 2.49 | 0.22 | 0.002 | 5.93 | 15.80 | 0.125 | 2.43 | — | |
| | H7 | 0.042 | 2.18 | 0.36 | 0.002 | 5.85 | 15.10 | 0.098 | 2.65 | — | |
| (2) | A | 0.105 | 0.52 | 1.05 | 0.004 | 7.09 | 16.82 | 0.025 | 0.05 | — | SUS301 |
| | B | 0.120 | 0.50 | 1.13 | 0.006 | 7.54 | 17.50 | 0.015 | 0.07 | — | SUS301 |
| | C | 0.085 | 0.41 | 0.57 | 0.005 | 7.39 | 16.72 | 0.011 | 0.05 | 1.18 | SUS631 |
| (3) | a | 0.013 | 2.69 | 0.30 | 0.008 | 9.91 | 12.01 | 0.016 | 1.70 | — | |
| | b | 0.027 | 2.01 | 0.42 | 0.005 | 7.96 | 14.93 | 0.061 | 0.91 | — | |
| | c | 0.104 | 0.28 | 1.00 | 0.007 | 6.59 | 16.07 | 0.017 | 1.79 | — | |
| | d | 0.063 | 0.22 | 1.00 | 0.006 | 6.60 | 15.68 | 0.062 | 1.80 | — | |
| | e | 0.074 | 2.78 | 1.47 | 0.008 | 5.59 | 15.43 | 0.061 | 1.92 | — | |
| | f | 0.071 | 2.83 | 2.10 | 0.002 | 7.91 | 13.40 | 0.086 | 0.03 | — | |

Note
(1): Steels according to the invention
(2): Steels conventionally used
(3): Control steels

TABLE 2

| | | | | As rolled | | | Age hardened at 400° C. for 1 hr | | | |
|---|---|---|---|---|---|---|---|---|---|---|
| Cl. | Steel | reduction rate (%) | α amount (%) | Hardness Hv (10) | tensile strength (kg/mm²) | elongation (%) | Hardness Hv (10) | tensile strength (kg/mm²) | elongation (%) | ΔH |
| (1) | H1 | 40 | 63.0 | 455 | 154 | 6.7 | 547 | 185 | 3.2 | 92 |
| | | 45 | 68.5 | 469 | 163 | 5.0 | 568 | 200 | 2.5 | 99 |
| | | 50 | 72.0 | 488 | 169 | 4.0 | 589 | 206 | 2.1 | 101 |
| | | 55 | 74.5 | 500 | 175 | 3.1 | 599 | 220 | 1.7 | 96 |

TABLE 2-continued

| Cl. | Steel | reduction rate (%) | α amount (%) | As rolled Hardness Hv (10) | As rolled tensile strength (kg/mm²) | As rolled elongation (%) | Age hardened at 400° C. for 1 hr Hardness Hv (10) | Age hardened at 400° C. for 1 hr tensile strength (kg/mm²) | Age hardened at 400° C. for 1 hr elongation (%) | ΔH |
|---|---|---|---|---|---|---|---|---|---|---|
| | H2 | 40 | 63.5 | 481 | 167 | 6.1 | 580 | 196 | 3.1 | 99 |
| | | 45 | 64.5 | 502 | 175 | 4.4 | 601 | 208 | 2.3 | 99 |
| | | 50 | 67.0 | 520 | 183 | 4.0 | 612 | 219 | 2.0 | 92 |
| | | 55 | 69.5 | 534 | 191 | 3.4 | 628 | 225 | 1.6 | 94 |
| | H3 | 50 | 55.0 | 451 | 159 | 5.3 | 525 | 183 | 2.7 | 74 |
| | | 55 | 63.5 | 473 | 173 | 3.2 | 544 | 200 | 2.1 | 71 |
| | H4 | 50 | 57.5 | 434 | 152 | 5.7 | 515 | 181 | 2.8 | 81 |
| | | 60 | 73.0 | 482 | 169 | 4.3 | 571 | 200 | 2.2 | 89 |
| | H5 | 50 | 47.0 | 472 | 166 | 5.4 | 535 | 180 | 2.5 | 64 |
| | | 55 | 55.0 | 484 | 173 | 4.4 | 550 | 190 | 2.2 | 66 |
| | H6 | 45 | 43.5 | 469 | 162 | 5.9 | 571 | 196 | 3.0 | 102 |
| | | 50 | 49.0 | 490 | 170 | 5.0 | 595 | 205 | 2.1 | 105 |
| | | 55 | 54.0 | 511 | 178 | 4.1 | 619 | 219 | 1.7 | 108 |
| | H7 | 45 | 45.5 | 428 | 147 | 7.2 | 526 | 178 | 3.1 | 98 |
| | | 50 | 51.5 | 440 | 151 | 6.3 | 541 | 180 | 2.6 | 101 |
| | | 55 | 57.3 | 456 | 159 | 4.4 | 551 | 187 | 2.0 | 95 |
| (2) | A | 45 | 39.5 | 440 | 149 | 6.7 | 467 | 155 | 3.5 | 27 |
| | | 50 | 43.5 | 451 | 155 | 5.1 | 490 | 163 | 2.4 | 39 |
| | | 55 | 47.0 | 465 | 162 | 4.5 | 503 | 171 | 1.5 | 38 |
| | | 65 | 55.0 | 520 | 182 | 1.8 | 560 | 200 | 0.4 | 40 |
| | B | 55 | 32.5 | 464 | 161 | 4.5 | 506 | 178 | 1.8 | 40 |
| | | 60 | 45.0 | 504 | 177 | 2.4 | 544 | 192 | 1.4 | 40 |
| | C* | 45 | 44.5 | 420 | 143 | 7.0 | 520 | 182 | 1.7 | 100 |
| | | 50 | 49.0 | 445 | 153 | 5.6 | 549 | 189 | 1.2 | 104 |
| | | 55 | 58.0 | 451 | 159 | 4.6 | 558 | 195 | 1.1 | 107 |
| (3) | a | 50 | 43.0 | 379 | 127 | 4.3 | 476 | 160 | 2.1 | 95 |
| | | 60 | 55.5 | 410 | 136 | 2.9 | 506 | 171 | 1.0 | 96 |
| | b | 50 | 56.0 | 415 | 140 | 5.2 | 482 | 164 | 2.8 | 67 |
| | | 60 | 65.0 | 441 | 149 | 3.1 | 507 | 172 | 1.4 | 66 |
| | c | 50 | 60.5 | 473 | 165 | 4.4 | 514 | 180 | 2.0 | 43 |
| | | 60 | 69.0 | 500 | 183 | 1.9 | 542 | 195 | 1.6 | 42 |
| | d | 50 | 67.0 | 444 | 157 | 2.6 | 503 | 174 | 2.3 | 59 |
| | | 60 | 76.0 | 459 | 172 | 2.0 | 516 | 182 | 1.5 | 57 |
| | e | 40 | 48.0 | 459 | 160 | 5.6 | 549 | 188 | 1.8 | 90 |
| | | 45 | 50.5 | 473 | 162 | 5.0 | 558 | 194 | 1.7 | 85 |
| | | 50 | 55.5 | 486 | 167 | 4.0 | 580 | 202 | 1.5 | 94 |
| | | 55 | 59.5 | 499 | 173 | 3.3 | 592 | 212 | 1.2 | 93 |
| | f | 50 | 46.5 | 447 | 149 | 4.8 | 500 | 170 | 2.1 | 53 |
| | | 60 | 54.0 | 479 | 161 | 2.7 | 528 | 180 | 0.9 | 49 |

Note:
Cl: Class
(1): Steels according to the invention
(2): Steel conventionally used
(3): Control steels
*Aged hardened at 480° C. for 1 hr

Examples of Blade

Using steps and conditions by which the results shown in Tables2 had been obtained, Steels H1, H2 and H6 according to the invention and Steels A and C conventionally used, were made into cold rolled and age hardened sheets of the same thickness of 0.13 mm. Reduction rates used in the cold rolling step are indicated in Table 3. An annular disc as shown in FIG. 3 was prepard from each sheet, and particulate diamond was electrically deposited along inner peripheral edges thereof to provide a saw blade. In FIG. 3, the reference numerals 2 designate apertures for the passages of bolts in mounting the blade on a slicing machine. The reference numeral 9 designates a round hollow scooped at the center of the substrate disc. The reference numeral 10 designates a blade edge consisting essentially of particulate diamond electrically deposited along inner peripheral edge portions of the annular disc. This saw blade is a so-called inner diameter type having the blade edge along inner periphery of the annular disc.

Figure 4:
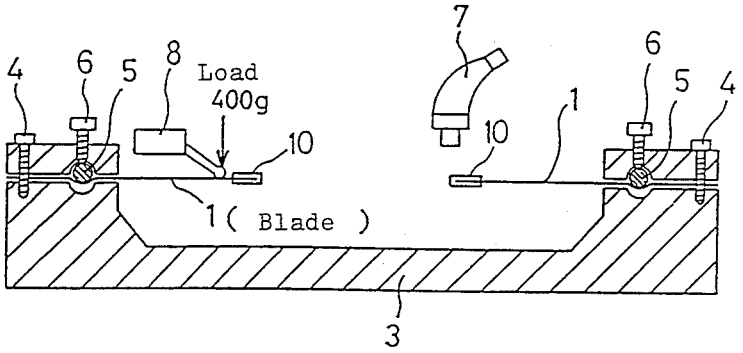
FIG. 4 is a schematic vertical cross-sectional view for illustrating a tension test of a blade; and, FIG. 5 is a graph showing relationships between a radial expansion rate of the inner diameter of an annular disc of the tested blades and a tension value T exerted by a test load.
Figure 5:
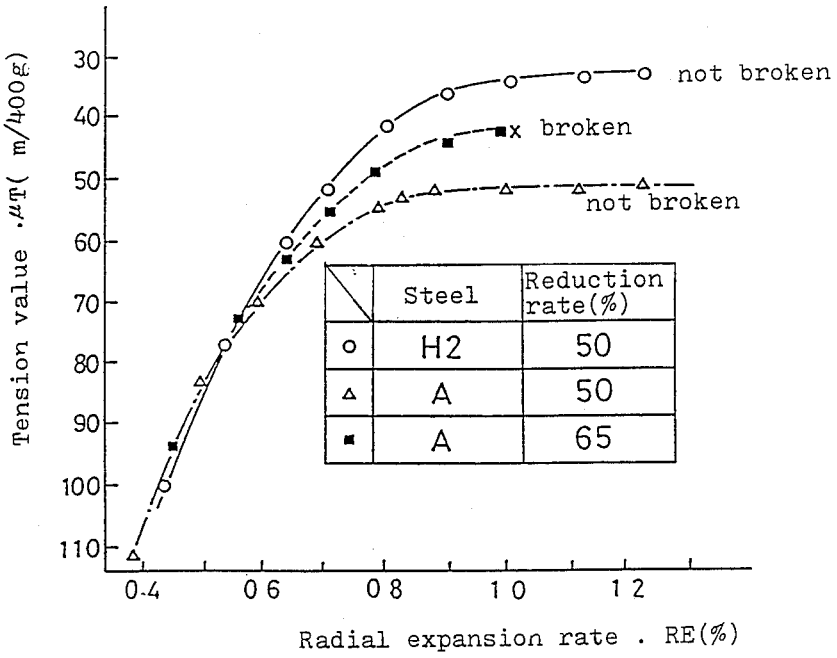

The blade so prepared was set on a chack body 3 ( slicing machine) as shown in FIG. 4. The setting was made by fixing outer periphery portions of the blade by passing bolts 4 through apertures 2 and tightening them, and thereafter pressing an O ring 5 against the annular disc 1 by means of bolts 6. Thus, a tension, which would radially expand the inner periphery of the annular disc, was exerted. The radial expansion rate (RE%) of the inner periphery of the tensioned blade was determined by means of a microscope 7. A weight of 400 g was loaded on the tensioned blade at a position radially outwardly deviated by 5 mm from the inner periphery of the annular disc, and the amount of displacement of the blade due to the load was determined by means of an electro-micrometer 8. This amount of displacement (micron/400 g) is referred to herein as a Tension value T. The relationship between the radial expansion rate (RE%) and the tension value T provide a measure for determining a tension state of the blade necessary for slicing a rod material such as a single crystal of silicon. The results of the measurements on Steels H2 and A are shown in FIG. 5. Each steel was cold rolled at a reduction rate indicated in FIG. 5 and age hardened at 400° C. for 1 hour.

After the measurements the blades were used for slicing a 6 inch- rod of Si single crystal to wafers and tested for durability, that is number of wafers safely sliced by a single blade. The results are shown in Table 3 together with reasons for stopping of slicing.

TABLE 3

| Class | Steel | rolling reduction (%) | number of sliced wafers | Reasons for stopping of slicing |
|---|---|---|---|---|
| (1) | H1 | 50 | 4000 | Plastic deformation of blade edge, impossible to continue |
| | H2 | 50 | 4700 | Plastic deformation of blade edge, impossible to continue |
| | H6 | 55 | 4200 | Plastic deformation of blade edge, impossible to continue |
| (2) | A | 50 | 1200 | Plastic deformation of blade edge, impossible to continue |
| | A | 65 | 200 | Disc broke due to poor elongation Fatigue cracking occurred during slicing |
| | C | 55 | 1100 | |

Note
(1): Steels according to the invention
(2): Steels conventionally used

The following is revealed from FIG. 5 and Table 3. In the case of Steel A cold rolled at a reduction rate of 50%, at T values providing an oprimum tention state, the disc is in the plastic deformation range, and thus, if even a slight weight is loaded during slicing, the blade edge is liable to yield, as reflected by a short service life shown in Table 3. In the case of Steel A cold rolled at a rolling reduction of 65%, having increased strength, at T values providing an optimum raision state the disc does not yet reach the plastic deformation range. However, because of its poor elongation the disc often breaks if it experiences an excessive tension. In particular, it is liable to break during slicing even with a slight deformation. As a result, the service life is shorter than that of the same steel cold rolled at a reducrion rate of 50%, as revealed from Table 3.

In contrast, in the case of Steel H2, according to the invention, cold rolled at a reduction rate of 50%, the disc does not reach the plastic deformation range at T values providing an optimum tension state of the blade, and even if further tensioned, the disc does not break (. see FIG. 5) since it has a considerable elongation. Even if the disc is deformed to some extent during service, it does not break, and is durable until the blade edge undergoes plastic deformation, whereby the number of wafers which can be prepared by a single blade may be increased (see Table 3). Further, when the disc has been deformed during service, it may be further tensioned to continue slicing, and thus, the service life is remarkably long. The same can be said for Steels H1 and H6. When compared with known saw blades wherein the disc substrate is made of steels conventionally used, the saw blades according to the invention have a long service life and are productive of many wafers (see Table 3).

We claim:

1. A slicing saw blade comprising a substrate disc and a blade edge consisting essentially of a ultra-hard material, which is diamond, deposited along a peripheral edge of said substrate disc, said substrate disc being made of a steel consisting essentially of, by weight, not more than 0.10% of C, more than 1.0% but not more than 3.0% of Si, less than 0.5% of Mn, from 4.0% to 8.0% of Ni, from 12.0% of 18.0% of Cr, from 0.5% to 3.5% of Cu, not more than 0.15% of N and not more than 0.004% of S, the sum of C and N being at least 0.10%, the balance being Fe and unavoidable impurities.

2. A slicing saw blade comprising a thin annular substrate disc having a round hollow scooped at its center and a blade edge consisting essentially of a particulate diamond deposited along the inner periphery of said annular disc, said substrate disc being made of a steel consisting essentially of, by weight, not more than 0.10% of C, more than 1.0% but not more than 3.0% of Si, less than 0.5% of Mn, from 4.0% to 8.0% of Ni, from 12.0% to 18.0% of Cr, from 0.5% to 3.5% of Cu, not more than 0.15% of N and not more than 0.004% of S, the sum of C and N being at least 0.1%, the balance being Fe and unavoidable impurities.

* * * * *